United States Patent [19]

Corbley et al.

[11] 4,001,634

[45] Jan. 4, 1977

[54] DISCHARGE LAMP HAVING THERMAL SWITCH STARTER

[75] Inventors: Eugene K. Corbley, Cleveland Hts., Ohio; Richard L. Collister, Jr., Missoula, Mont.

[73] Assignee: General Electric Company, Schenectady, N.Y.

[22] Filed: Sept. 2, 1975

[21] Appl. No.: 609,217

[52] U.S. Cl. ..... 315/73; 315/47; 315/74; 315/103; 315/104

[51] Int. Cl.[2] ..... H01J 61/56

[58] Field of Search ..... 315/73, 46, 47, 56, 315/74, 100, 103, 104, 106, 107; 313/25, 184, 229, 312; 328/7; 337/33, 34

[56] References Cited

UNITED STATES PATENTS

| | | | |
|---|---|---|---|
| 2,286,789 | 6/1942 | Dench | 315/47 X |
| 3,226,597 | 12/1965 | Green | 315/74 X |
| 3,746,914 | 7/1973 | Olson et al. | 315/47 |

FOREIGN PATENTS OR APPLICATIONS

| | | | |
|---|---|---|---|
| 1,467,050 | 12/1966 | France | |
| 1,509,088 | 12/1967 | France | |
| 48-15985 | 5/1973 | Japan | |
| 1,095,055 | 12/1967 | United Kingdom | 315/73 |

*Primary Examiner*—Eugene La Roche
*Attorney, Agent, or Firm*—Ernest W. Legree; Lawrence R. Kempton; Frank L. Neuhauser

[57] ABSTRACT

A high pressure sodium vapor lamp utilizing an alumina ceramic arc tube within an outer glass envelope is provided with a bi-metal switch which short circuits the arc tube at starting. Current flow through the switch causes it to heat up and open the short circuit, producing a voltage pulse which starts the lamp. The bi-metal is fastened to a pin conductor extending from the metal exhaust tube of the arc tube to the frame. The pin conductor, which receives heat by conduction from the exhaust tube and is also heated by lamp current flow, transmits sufficient heat to the bi-metal to maintain it deflected during normal operation.

12 Claims, 3 Drawing Figures

Fig. 1
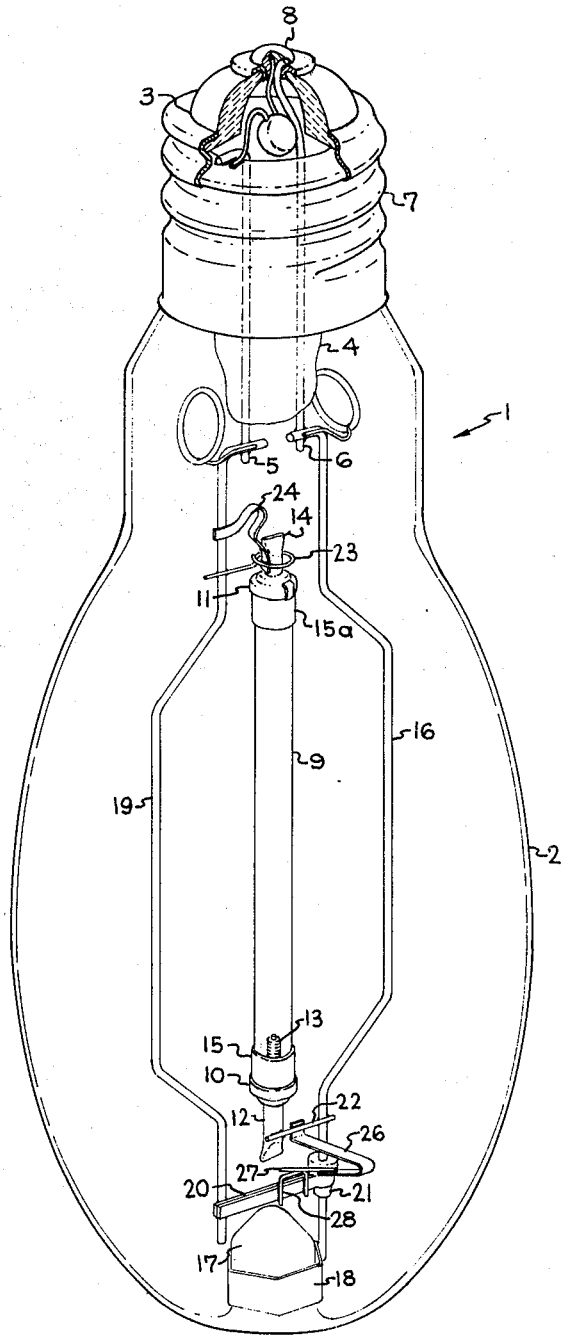
Fig. 2
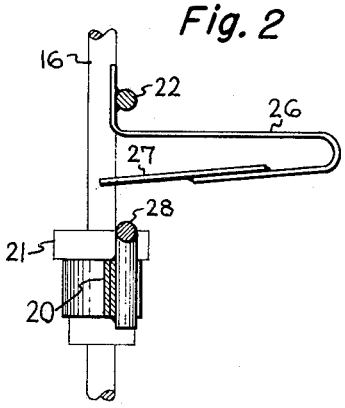
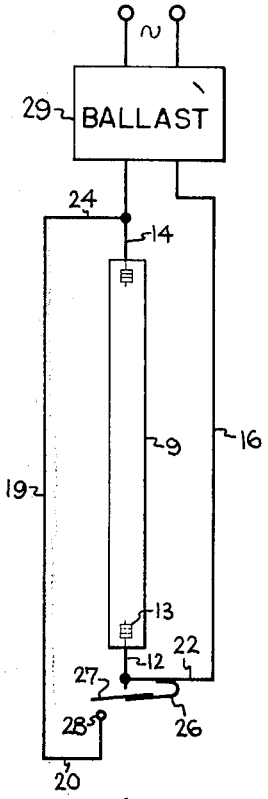
Fig. 3

DISCHARGE LAMP HAVING THERMAL SWITCH STARTER

The invention relates to high pressure metal vapor lamps and more specifically high pressure sodium vapor lamps utilizing alumina ceramic envelopes. The invention is particularly concerned with a thermal snap starter switch for starting such lamps.

BACKGROUND OF THE INVENTION

High intensity sodium vapor lamps of the present kind are described in U.S. Pat. No. 3,248,590, Schmidt, entitled "High Pressure Sodium Vapor Lamp." These lamps utilize a slender tubular envelope of light-transmissive refractory oxide material resistant to sodium at high temperatures, suitably high density polycrystalline alumina or synthetic sapphire. The filling comprises sodium along with a rare gas to facilitate starting, and mercury for improved efficiency. The ends of the alumina tube are sealed by suitable closure members affording connection to thermionic electrodes which may comprise refractory metal structures activated by electron emissive material. The ceramic arc tube is generally supported within an outer glass envelope or jacket provided at one end with the usual screw base. the electrodes of the arc tube are connected to the terminals of the base, that is to shell and center contact, and the interenvelope space is usually evacuated in order to conserve heat.

For maximum efficiency in high pressure sodium vapor lamps xenon is used as the starting gas. The use of xenon provides an advantage in efficiency of 10% or more over the lighter inert gas neon, and even more over a Penning mixture, such as a 99% neon-1% argon mixture. However the choice of xenon makes the lamp difficult to start. The starting voltage requirement has commonly been met by including in the ballast an electronic circuit which serves as a source of short duration high voltage pulses. After the lamp is ignited, the voltage across it is reduced and a sensing circuit responds thereto and disables the starting pulse generator. Such circuitry is relatively expensive and is proportionately more so in the smaller sizes of lamps.

Another expedient which has been used for starting is a thermal switch such as a bi-metal which is connected in series with a heating coil across the arc tube terminals. At starting the lamp is short circuited by the switch and current flows through the heater. This heats the switch until it opens whereupon interruption of current flow through the ballast produces an inductive voltage surge which should start the lamp. The switch and its heater are designed to have enough thermal inertia to remain deflected until the arc tube warms up and heats it by radiation. Should the switch contacts open at a moment in the A.C. cycle when the induced voltage is insufficient to start the lamp, an interval will follow during which the bi-metal must cool, close, and be heated to reopen again. This cycle may take well in excess of a minute; in a typical commercially available lamp manufactured in England, the cycle took from 1½ to 2 minutes and the lamp frequently failed to start after 3 such cycles. The poor reliability of the lamp with respect to its starting characteristics, frequently entailing delays of 5 minutes or more before the arc tube even starts to warm up, has prevented general acceptance of this design.

SUMMARY OF THE INVENTION

The object of our invention is to provide a thermal starter which starts the lamp quickly and reliably.

In accordance with our invention we have overcome the problems of the prior art thermal starter by a new design of snap starter comprising a thermal actuator, suitably a bi-metal switch, of low thermal mass and high enough resistance to be quickly deflected by self heating caused by the short circuit current. The actuator is attached to an integral current conducting part of the lamp which is also heated both by current flow through its inherent resistance and by thermal conduction from the arc tube end in addition to radiant heating.

In a preferred construction the bi-metal is fastened to a pin conductor extending from the metal exhaust tube of the arc tube to the frame which supports it within the outer envelope. The pin conductor, which receives heat by conduction from the exhaust tube and is also heated by lamp current flow, transmits sufficient heat to the bi-metal to maintain it deflected during normal operation.

DESCRIPTION OF THE DRAWING

In the drawing:

FIG. 1 is a side view of a high pressure sodium vapor discharge lamp embodying the invention and showing the thermal switch in its closed position.

FIG. 2 is an enlarged detail of the switch shown in the open position which it takes during normal operation.

FIG. 3 is a schematic wiring diagram of a typical electric circuit used with this invention.

DETAILED DESCRIPTION

A high pressure sodium vapor lamp 1 of approximately 150 watt rating embodying the invention in preferred form is illustrated in FIG. 1, although this invention is applicable to other types of gaseous discharge lamps. It comprises an outer envelope 2 of glass to the neck of which is attached a standard mogul screw base 3. The outer envelope comprises a reentrant stem press 4 through which extend, in conventional fashion, a pair of relatively heavy lead-in conductors 5,6 whose outer ends are connected to the screw shell 7 and eyelet 8 of the base.

The arc tube 9 centrally located within the outer envelope comprises a length of polycrystalline alumina tubing. End closures consisting of metal caps 10,11 of niobium which matches the expansion coefficient of alumina ceramic are sealed to the ends of the tube by means of a glassy sealing composition. The lower end cap 10 has a metal tube 12 sealed through it which serves as an exhaust and fill tubulation during manufacture of the lamp. The exhaust tube is sealed off at its outer end and serves as a reservoir in which excess sodium-mercury amalgam condenses during operation of the lamp, the illustrated lamp being intended for base-up operation. Electrode 13 within the lamp is attached to the inward projection of exhaust tube 12 and a dummy exhaust tube 14 extending through metal end cap 11 supports a corresponding electrode at the upper end. Metal bands 15 and **15*a*** wrapped around the ends of the arc tube are heat reflectors serving to raise the end temperature.

The arc tube mount comprises a side rod 16 extending from inlead 6 to the dome end of the envelope 2 where the distal end of the rod is braced to inverted nipple 17 by a clip 18 which engages it. A second side rod 19 extends from inlead 5 on the opposite side of the arc tube towards the dome end where it is braced to the first side rod by a transverse metal strap 20 which wraps around an insulating bead 21 on side rod 16. Exhaust tube 12 is connected by welded pin connector 22 to side rod 16. Pin connector 22 is important in regulating the heat loss from metal tube reservoir 12 and thereby the sodium vapor pressure in the lamp, and may be referred to as a control conductor. Dummy exhaust tube 14 extends through a ring support 23 fastened to side rod 19 which provides lateral restraint while allowing axial expansion of the arc tube. A flexible metal strap 24 connects dummy exhaust tube 14 to side rod 19.

The thermal switch proper comprises a bi-metal strip 26 folded back upon itself to a hairpin shape and welded to pin connector 22 at its fixed end. The strip material, sometimes termed thermostat metal, is a composite made up of two metallic layers of different coefficients of expansion permanently bonded together. A nickel-iron alloy known as invar is generally used for the low expansion component or low side, and a nickel-chrome-steel alloy for the high expansion component or high side. The relative change in length of the two components as the temperature is raised causes the strip to curve or bend. One suitable thermostat metal available from Texas Instruments, Inc. is known as Truflex type E5 wherein high and low sides are equal in thickness, and the high side identified as alloy E consists of 25% Ni, 8.5% Cr, balance Fe, and the low side identified as alloy 50 consists of 50% Ni and 50% Fe (invar). In the illustrated example, the strip used is 0.005 inch (0.013 cm) thick × ⅛ inch (0.318 cm) wide of which a piece about 1 inch (2.54 cm) long is folded back upon itself. Using this type E5 material and these typical dimensions, the electrical resistance of the bi-metal strip is approximately 0.04 ohm. In a second example, the strip is the same except for its width which is reduced to 0.08 inch (0.203 cm), and the electrical resistance is increased to approximately 0.06 ohm. A short length of tungsten wire 27 is welded to the free end of the strip and projects in a straight line. Wire 27 crosses over and makes contact to a stirrup-shaped tungsten wire 28 which is welded to metal strap 20 in a fashion to project above it. The switch circuit is thus completed by a tungsten-to-tungsten contact. Direct contact to the thin bi-metal strip at the switch contact points is avoided to prevent degradation of the bi-metal strip and to improve contact reliability.

In the rest position of the switch illustrated in FIG. 1, it provides a direct short circuit across the arc tube and draws short circuit current through itself from the lamp ballast. When used with a typical ballast for a 150 watt sodium vapor lamp, this short circuit current is approximately 2.5 amperes. The flow of short circuit current through the bi-metal strip 26 causes it to heat and deflect upwardly, whereby contact between tungsten wire 27 and stirrup 28 is broken, as shown in FIG. 2. In the first example (illustrated) the flow of short circuit current of 2.5 amperes through the 0.04 ohm resistance of the low-mass bi-metal strip dissipates approximately 0.25 watt. The heat generated over a time interval of about 5 seconds is equivalent to 1.25 watt-seconds or joules corresponding to 0.30 gram-calorie, and will raise the temperature of the bi-metal strip in this environment about 28° C which is sufficient to open the contacts. In the second example, the same short circuit current flow through a resistance of 0.06 ohm will dissipate about 0.38 watt. This will raise the temperature by the same amount in about 2 seconds. In general, the mass of the bi-metal and its thermal activity when operating in a near vacuum should provide sufficient movement to open switch contacts 27–28 by self-heating from current flow in less than 15 seconds, and preferably in 5 seconds or less. The contacts should open upon expenditure of less than 4 joules, and preferably 1.25 joules or less.

The sudden cut off of current flow through the inductive ballast 29 (FIG. 3) when switch contacts 27–28 open generates an inductive voltage pulse which may be sufficient to ionize the starting gas in the lamp and start it. The starting gas may be any inert gas, but for easy starting a Penning mixture of 99% neon and 1% argon is preferred. For example, the ballast 29 may have a normal open circuit voltage of 240 volts, r.m.s., while lamp 1 may require approximately a 300 volt instantaneous pulse for reliable ignition of the gaseous discharge. Provided switch 27–28 opens the circuit when the instantaneous alternating current is significantly greater than zero, the resulting inductive voltage pulse from energy stored in the ballast may well equal or exceed 300 volts, and thus initiate discharge through the starting gas in discharge tube 9. After such an initial breakdown, the lamp will continue to operate on the voltage normally provided by the ballast, while the ballast limits current flow through the lamp to the designed value.

When the discharge starts, lamp impedance rapidly diminishes as current flow builds up to the normal operating value. Bi-metal member 26 is no longer being heated by current flowing through it but will remain open because lamp current is flowing through pin conductor 22 and resistive heating takes place. At the same time, conduction of heat from exhaust tube 12 of the lamp through pin conductor 22 provides additional heating to the bi-metal which supplements the resistive heating due to current flow. After the arc tube has warmed up to operating temperature, there is additional radiant heating provided. The bi-metal switch is therefore maintained in an open position as illustrated in FIG. 2 and will not return to its original short circuiting position. Occasionally it does happen that the switch recloses in the first few seconds after the lamp has started. However the switch then reopens and again starts the lamp and no harm is done.

The lamp generally starts on the first opening of the switch. If it fails to start, the switch will rapidly cool, close and short circuit the arc tube whereupon the switch recycles and opens again for another attempt. It will make repeated attempts to start the lamp at intervals of short duration, for example less than 5 seconds. The lamp will almost always start by the third attempt. Our invention thus provides a fast acting snap starter which will generally start the lamp within 5–15 seconds or less of turning it on. Such performance is quite satisfactory for commercial applications.

The illustrated lamp is intended for base up operation and metal tube reservoir 12 along with pin connector 22 and switch 26 are located at the dome end which is lowermost in operation. In a lamp for base down operation, the arc tube is turned end for end and the metal tube reservoir 12 is located at the base end in order to be lowermost in operation. The pin connector and the switch are also moved to the base end since they are associated with the metal tube reservoir. In such construction it is not necessary to have a second side rod extending the length of the arc tube and a short stub connector reaching only to the proximate end of the arc tube may be used to which the pin connector is welded.

What we claim as new and desire to secure by Letters Patent of the U.S. is:

1. A vapor discharge lamp of the type adapted to be operated from an inductive ballast comprising:

an outer vitreous envelope domed at the distal end and having a base attached to the near end, and a pair of lead-in wires sealed into said envelope and connected to said base;

an arc tube having electrodes sealed therein and containing a charge of vaporizable metal and inert starting gas, said arc tube having at one end a sealed-off metal tube serving as a reservoir for excess vaporizable metal;

a mounting frame within said envelope comprising one side rod extending from one lead-in wire along the length of the arc tube towards the dome end of said envelope;

said arc tube having a connection from the electrode at the distal end to said side rod, and a connection from the electrode at the near end to the other lead-in wire, one of said connections being formed by a control conductor attached directly to said sealed-off metal tube reservoir;

and a thermal switch comprising a bi-metal member having its restrained end fastened to said control conductor and its free end adapted to engage a contact connected to said other connection whereby to short circuit said arc tube at starting, said bi-metal having a thermal mass in relation to its electrical resistance low enough that it is quickly deflected by self heating caused by short circuit current therethrough in order to open said contacts and start said arc tube.

2. A lamp as in claim 1 wherein said bi-metal member is a thin strip formed to a generally hairpin shape and having a projecting tungsten wire welded to its free end for making contact with a tungsten contact connected to said other connection.

3. A lamp as in claim 1 wherein said arc tube comprises an alumina ceramic envelope and the charge of vaporizable metal comprises sodium and mercury.

4. A lamp as in claim 1 for base up operation wherein the metal tube reservoir of the arc tube is located at the dome end of the outer envelope and said control conductor to which the bi-metal member is fastened extends from the metal tube reservoir to said side rod.

5. A lamp as in claim 1 for base down operation wherein the metal tube reservoir of the arc tube is located at the base end of the outer envelope and said control conductor to which the bi-metal member is fastened extends from the metal tube reservoir to a connector extending from said other lead-in wire.

6. A vapor discharge lamp of a type adapted to be operated from an inductive ballast comprising:

an outer sealed vitreous envelope having a base attached thereto including means for making exterior electrical connections to a pair of lead-in wires sealed into said envelope;

an arc tube having electrodes sealed therein and containing a charge of vaporizable metal and inert starting gas, said arc tube having sealed through one end a metal conductor of relatively large thermal conduction capacity which is contacted by the excess vaporizable metal therein;

a mounting frame within said envelope comprising a first side rod extending from one lead-in wire along the length of the arc tube and a second side rod extending from the other lead-in wire in spaced relation to said first side rod, connections from the electrodes to said side rods, one of said connections being formed by a control conductor attached to said metal conductor of relatively large thermal conduction capacity and extending directly to said second side rod;

and a thermal switch comprising a bi-metal member having its restrained end fastened to said control conductor and its free end adapted to engage a contact connected to said first side rod whereby to close said switch and short circuit said arc tube at starting, said bi-metal having a thermal mass in relation to its electrical resistance low enough that it is quickly deflected by self heating caused by short circuit current therethrough whereby to open said switch.

7. The combination of claim 6 wherein the self-heating from short-circuit through said thermal switch raises its temperature to switch-open condition within 15 seconds.

8. The combination of claim 6 wherein the self-heating from short-circuit current through said thermal switch raises its temperature to switch-open condition within 5 seconds.

9. The combination of claim 6 wherein the energy required to open said switch is less than 4 joules.

10. The combination of claim 6 wherein the energy required to open said switch is less than 1.25 joules.

11. The combination of claim 6 wherein said bi-metal member is formed in a generally hairpin shape.

12. The combination of claim 6 wherein said switch contacts are tungsten.

* * * * *